US009766569B2

(12) United States Patent
Yamana

(10) Patent No.: US 9,766,569 B2
(45) Date of Patent: Sep. 19, 2017

(54) IMAGE FORMING APPARATUS WITH CORONA CHARGER CLEANING

(71) Applicant: CANON KABUSHIKI KAISHA, Tokyo (JP)

(72) Inventor: Kentarou Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/098,874

(22) Filed: Apr. 14, 2016

(65) Prior Publication Data

US 2016/0223931 A1 Aug. 4, 2016

Related U.S. Application Data

(63) Continuation of application No. PCT/JP2014/079002, filed on Oct. 24, 2014.

(30) Foreign Application Priority Data

Oct. 25, 2013 (JP) ..... 2013-222603

(51) Int. Cl.
*G03G 15/02* (2006.01)

(52) U.S. Cl.
CPC ..... *G03G 15/0258* (2013.01); *G03G 15/0291* (2013.01); *G03G 2215/0129* (2013.01);
(Continued)

(58) Field of Classification Search
CPC ..... G03G 15/0291; G03G 21/1661; G03G 2215/026; G03G 2215/027; G03G 2221/1693; H01T 19/00
(Continued)

(56) References Cited

U.S. PATENT DOCUMENTS 3,922,548 A * 11/1975 Honda ..... G03G 15/0291 250/324
5,008,538 A * 4/1991 DeCecca ..... H01T 19/00 250/324

(Continued)

FOREIGN PATENT DOCUMENTS

JP 03096976 A * 4/1991
JP 6-333669 A 12/1993

(Continued)

OTHER PUBLICATIONS

International Search Report dated Dec. 22, 2014, in International Application No. PCT/JP2014/079002.

*Primary Examiner* — Robert Beatty
(74) *Attorney, Agent, or Firm* — Fitzpatrick, Cella, Harper & Scinto

(57) ABSTRACT

An image forming apparatus includes a corona charger, first and second supporting members for supporting the corona charger on the respective sides of the corona charger with respect to the circumferential direction of a photosensitive member, and first and second urging portions for urging a shield of the corona charger in the first and second supporting members. The first urging portion and the second urging portion urge the shield at non-opposing positions relative to each other with respect to a longitudinal direction of the corona charger. The image forming apparatus enables suppression of charging non-uniformity due to vibration of the corona charger without impairing motion of a grid cleaning member.

16 Claims, 5 Drawing Sheets

(52) U.S. Cl.
CPC ..... *G03G 2215/027* (2013.01); *G03G 2221/1693* (2013.01)

(58) Field of Classification Search
USPC ..... 399/100, 115, 171, 172; 250/324, 325, 250/326
See application file for complete search history.

(56) References Cited

U.S. PATENT DOCUMENTS

| | | | | | |
|---|---|---|---|---|---|
| 5,576,820 | A | * | 11/1996 | Hagihara | G03G 15/1635 399/121 |
| 5,581,338 | A | * | 12/1996 | Nakamichi | G03G 15/6535 399/310 |
| 6,060,708 | A | * | 5/2000 | Grubner | H01T 19/00 250/324 |
| 8,644,731 | B2 | | 2/2014 | Tanaka | |
| 8,682,221 | B2 | | 3/2014 | Ichikawa et al. | |
| 8,837,977 | B2 | | 9/2014 | Tanaka | |
| 2001/0009621 | A1 | | 7/2001 | Nakazato et al. | |

FOREIGN PATENT DOCUMENTS

| | | | |
|---|---|---|---|
| JP | 06-250535 | A | 9/1994 |
| JP | 11-316537 | A | 11/1999 |
| JP | 2003-270898 | A | 9/2003 |
| JP | 2007-121460 | A | 5/2007 |
| JP | 2012-168460 | A | 9/2012 |
| JP | 2012-185299 | A | 9/2012 |
| JP | 2012-220793 | A | 11/2012 |
| JP | 2013-125137 | A | 6/2013 |

* cited by examiner

IMAGE FORMING APPARATUS WITH CORONA CHARGER CLEANING

TECHNICAL FIELD

The present invention relates to an image forming apparatus, such as a copying machine, a printer or facsimile machine, of an electrophotographic type or an electrostatic recording type.

BACKGROUND ART

Conventionally, for example, in the image forming apparatus using the electrophotographic type, a surface of an electrophotographic photosensitive member (photosensitive member) as a member-to-be-charged is electrically charged by a charger, and thereafter the charged surface of the photosensitive member is exposed to light depending on image information, so that an electrostatic latent image is formed on the surface of the photosensitive member. As the charger for charging the surface of the photosensitive member, a corona charger (discharger) has been widely used.

In general, the corona charger is provided with supporting blocks at respective end portions of a shield case constituting a supporting casing which opens at one surface, and a discharge wire constituted by a wire material made of a metal such as tungsten is extended and stretched between these supporting blocks. In the case where a surface-to-be-charged of the member-to-be-charged such as the photosensitive member is charged using the corona charger, an open surface of the shield case is caused to oppose the surface-to-be-charged in a close state, and corona discharge is generated by supplying a discharge current to the discharge wire, so that electric charges are imparted to the surface-to-be-charged. At the open surface of the shield case, a grid is provided between the discharge wire and the surface-to-be-charged and a grid bias is applied to the grid to adjust an electric charge amount, so that also control of a charge potential of the surface-to-be-charged has been effected.

When a contaminant such as a toner, an external additive or paper powder or the like is deposited on the grid of the corona charger, non-uniformity (charging spot) generates in a potential distribution with respect to a longitudinal direction (longitudinal direction of the corona charger) of the surface-to-be-charged, so that an image defect generates in some cases. Therefore, the corona charger is provided with a cleaning member for cleaning the grid in some cases. For example, by moving the cleaning member along the shield case in a longitudinal direction of the corona charger (reciprocating motion or the like), removal of the contaminant deposited on the grid has been made.

Incidentally, in the image forming apparatus, in the case where an image forming unit is detachably mountable to an apparatus main assembly or in the like case, it is required that the image forming unit is stably supported by the apparatus main assembly in a mounted state. When this supporting state is unstable, for example, the image defect which is called banding generates in some cases. The banding is periodical density non-uniformity, with respect to a sub-scan direction, generating on an image. This is caused by generation of a deviation in image writing position or image transfer position by vibration of the image forming unit including the photosensitive member. Therefore, Japanese Laid-Open Patent Application Hei 11-316537 discloses that the vibration is prevented by providing an urging member between the image forming units in order to suppress the banding.

Further, also in the case where not only the corona charger is used as the charger for charging the surface of the photosensitive member for example, but also the corona charger itself is detachably mountable to the apparatus main assembly, the density non-uniformity generates on the image in some cases depending on a supporting state of the corona charger. Specifically, this is because a supporting member such as rails for supporting the corona charger are provided adjacently to respective sides of the corona charger with respect to a short direction, and in the case where the corona charger is supported by this supporting member, vibration from a vibration generating source in the apparatus main assembly is transmitted to the corona charger via the supporting member to fluctuate a distance between the photosensitive member and the corona charger and thus potential non-uniformity generates. Therefore, also with respect to the corona charger, it would be considered that the vibration is suppressed by a means such as contact of the supporting member, as disclosed in Japanese Laid-Open Patent Application Hei 11-316537, between the supporting members disposed on the respective sides of the corona charger with respect to the circumferential direction of the photosensitive member.

SUMMARY OF THE INVENTION

Problem to be Solved by the Invention

However, as described in Japanese Laid-Open Patent Application Hei 11-316537, in the case where the urging member provided between the supporting member disposed on the respective sides of the corona charger with respect to the circumferential direction of the photosensitive member is disposed in the same longitudinal position of the corona charger, the shield is urged by the urging member, so that the shield of the corona charger is deformed in some cases. For example, in the case where the cleaning member for the grid moving along the shield case is provided as described above, a distance between the shields where a carriage as a movable member moving in the longitudinal direction of the corona charger while holding the cleaning member passes narrows, so that there was a liability that the carriage cannot pass through a portion urged by the urging member with respect to the longitudinal direction of the corona charger. As a result, there was a liability that movement of the cleaning member for the grid is impaired.

Therefore, an object of the present invention is to provide an image forming apparatus enabling suppression of charging non-uniformity due to vibration of the corona charger without impairing motion of the grid cleaning member in a constitution in which the corona charger is supported by the supporting members adjacent to the respective sides of the corona charger with respect to the circumferential direction of the photosensitive member.

Means for Solving the Problem

The above object is accomplished by an image forming apparatus according to the present invention. In summary, there is provided an image forming apparatus comprising:

a rotatable photosensitive member;

a corona charger for electrically charging the photosensitive member, the corona charger detachably mountable to an image forming apparatus main assembly and including a discharging electrode for effecting electric discharge, a shield surrounding the discharging electrode and including an opening opposing the photosensitive member, and a grid provided in the opening;

a cleaning member for cleaning the grid in contact with the grid while moving along a longitudinal direction of the corona charger;

a movable member moving in the longitudinal direction of the corona charger while holding the cleaning member;

a screw for moving the movable member in the longitudinal direction of the corona charger by engagement with the movable member; and a first supporting member and a second supporting member which are provided on respective sides of the corona charger with respect to a circumferential direction of the photosensitive member so as to sandwich the corona charger therebetween and which supports the shield at positions adjacent thereto, wherein the first supporting member has elasticity and is provided with a first urging portion for urging the shield, adjacent to the first supporting member, in a direction from a front surface of the shield close to the first supporting member toward a back surface, wherein the second supporting member has elasticity and is provided with a second urging portion for urging the shield, adjacent to the second supporting member, in a direction from the front surface of the shield close to the second supporting member toward the back surface, and wherein the first urging portion and the second urging portion are disposed so that a first portion-to-be-urged of the shield urged by the first urging portion and a second portion-to-be-urged of the shield urged by the second urging portion are in non-opposing positions to each other with respect to the longitudinal direction of the corona charger.

Effect of the Invention

According to the present invention, it becomes possible to suppress the charging non-uniformity due to the vibration of the corona charger without impairing the motion of the grid cleaning member in the constitution in which the corona charger is supported by the supporting members adjacent to the respective sides of the corona charger with respect to the circumferential direction of the photosensitive drum.

EMBODIMENTS FOR CARRYING OUT THE INVENTION

In the following, an image forming apparatus according to the present invention will be described in further detail in accordance with the drawings.

Embodiment 1

1. General Structure and Operation of Image Forming Apparatus

Figure 1:
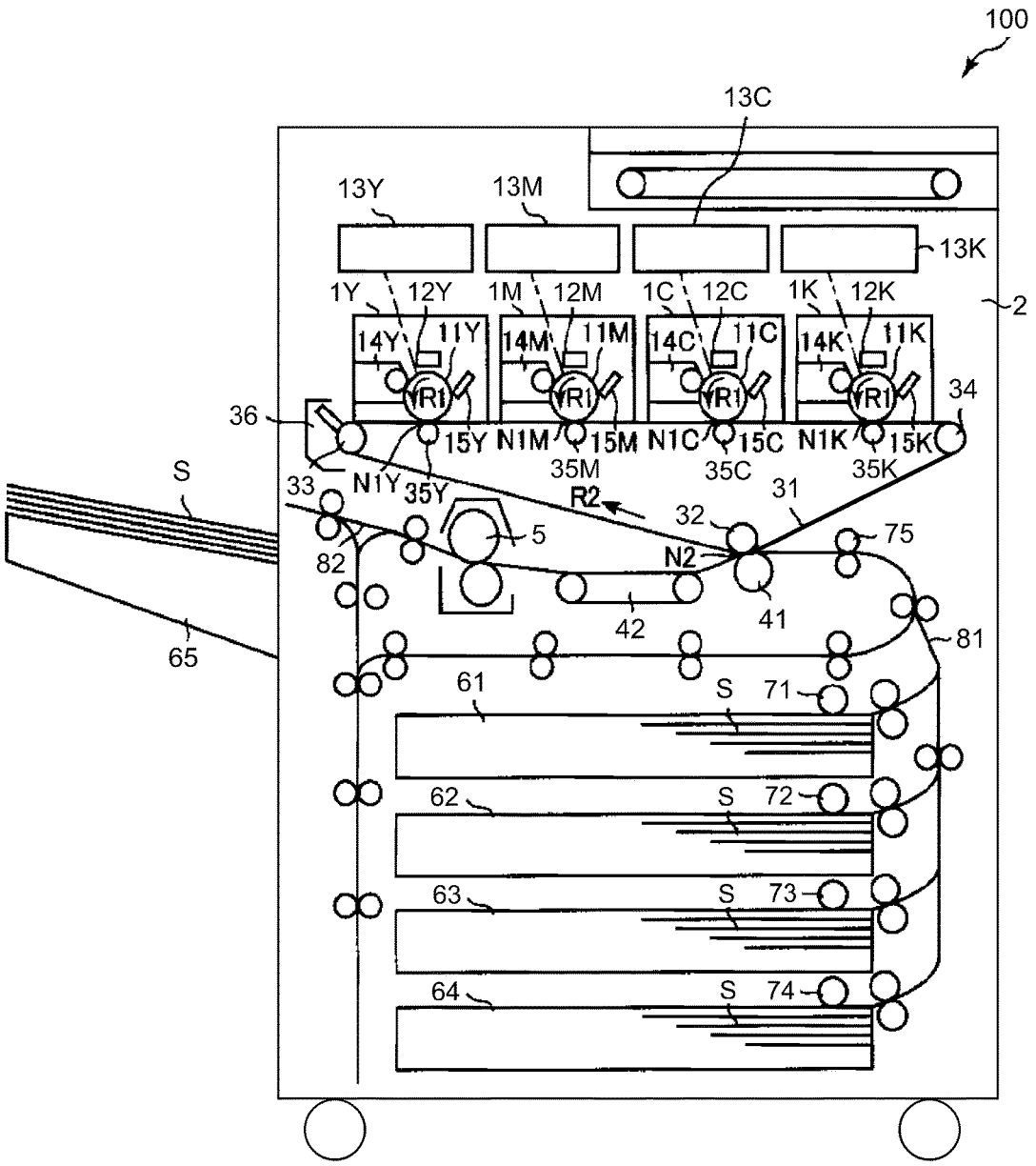
FIG. 1 is a schematic sectional view of an image forming apparatus.

FIG. 1 is a schematic sectional view of an image forming apparatus according to an embodiment of the present invention. An image forming apparatus 100 in this embodiment is a tandem type image forming apparatus employing an intermediary transfer type capable of formation of a full-color image.

The image forming apparatus 100 includes first, second, third and fourth image forming portions 1Y, 1M, 1C, 1K provided in a rectilinear line shape along a horizontal portion of an intermediary transfer belt 31 described later. The respective image forming portions 1Y, 1M, 1C, 1K form toner images of respective colors of yellow (Y), magenta (M), cyan (C) and black (K) by an electrophotographic type depending on image signals sent from an external device.

In this embodiment, structures and operations of the respective image forming portions 1Y, 1M, 1C, 1K are substantially the same except that colors of toners used are different. Accordingly, in the following, in the case where there is no need to make distinction in particular, suffixes Y, M, C, K of symbols representing elements provided for either of colors are omitted and will be described collectively with respect to the elements.

An image forming portion 1 includes a photosensitive drum 11 which is a drum-shaped (cylindrical) electrophotographic photosensitive member (photosensitive member) as an image bearing member. The photosensitive drum 11 is rotationally driven in an arrow R1 direction in the figure. At a periphery of the photosensitive drum 11, along a rotational direction thereof, the following means are provided. First, a charger 12 constituted by a corona charger as a charging means is disposed. Next, an exposure device 13 as an exposure means is disposed. Next, a developing device 14 as a developing means is disposed. Next, a primary transfer roller 35 which is a roller-shaped primary transfer member as a primary transfer means is disposed. Next, a cleaning device 15 as a photosensitive member cleaning means is disposed.

Further, an intermediary transfer belt 31 constituted by an endless belt as an intermediary transfer member is disposed so as to oppose the photosensitive drums 11Y, 11M, 11C, 11K of the image forming portions 1K, 1M, 1C, 1K. The intermediary transfer belt 31 is stretched by a driving roller 33, a tension roller 34 and a secondary transfer opposite roller 32 and is rotated (circulated and moved) in an arrow R2 direction in the figure by rotationally driving the driving roller 33. On an inner peripheral surface side of the intermediary transfer belt 31, at positions opposing the photosensitive drums 11Y, 11M, 11C, 11K, the primary transfer rollers 35Y, 35M, 35C, 35K are disposed. The primary transfer roller 35 is urged (pressed) toward the photosensitive drum 11 via the intermediary transfer belt 31, so that a primary transfer portion N1 where the intermediary transfer belt 31 and the photosensitive drum 11 are in contact with each other is formed. Further, on an outer peripheral surface side of the intermediary transfer belt 31, at a portion opposing the secondary transfer opposite roller 32, a secondary transfer roller 41 which is a roller-shaped secondary transfer member as a secondary transfer means is provided. The secondary transfer roller 41 is urged (pressed) toward the secondary transfer opposite roller 32 via the intermediary transfer belt 31, so that a secondary transfer portion N2 where the intermediary transfer belt 31 and the secondary transfer roller 41 are in contact with each other is formed. Further, on the outer peripheral surface side of the intermediary transfer belt 31, at a position opposing the driving roller 33, a belt cleaning device 36 as an intermediary transfer member cleaning means is provided.

In addition, the image forming apparatus 100 is provided with a feeding means for feeding a recording material S to the secondary transfer portion N2, a fixing means for fixing the toner image on the recording material S, and the like means.

During image formation, the photosensitive drum 11 is rotationally driven, and the surface of the rotating photosensitive drum 11 is electrically charged substantially uniformly by the charger 12. The surface of the charged photosensitive drum 11 is irradiated with image light depending on image information by the exposure device (laser scanner device) 13, so that an electrostatic latent image (electrostatic image) depending on the image information is formed. The electrostatic latent image formed on the photosensitive drum 11 is developed (visualized) as a toner image by transferring a toner as a developer onto the photosensitive drum 11 by the developing device 14. The toner image formed on the photosensitive drum 11 is transferred (primary-transferred) onto the intermediary transfer belt 31 at the primary transfer portion N1 by the action of the primary transfer roller 35. For example, during full-color image formation, by an operation as described above, the toner images of the respective colors formed on the photosensitive drums 11Y, 11M, 11C, 11K are successively transferred supposedly in the same image position on the intermediary transfer belt 31.

On the other hand, the recording material (sheet material) S such as recording sheets accommodated in sheet (paper) feeding cassettes 61, 62, 63, 64 is fed to a sheet embodiment path 81 by rotation of either of sheet feeding rollers 71, 72, 73, 74. This recording material S is fed by a registration roller 75 to the secondary transfer portion N2 by being timed to the toner images on the intermediary transfer belt 31. Then, at the secondary transfer portion N2, the toner images on the intermediary transfer belt 31 are transferred (secondary transferred) electrostatically onto the recording material S by the action of the secondary transfer roller 41.

The recording material S on which the toner images are transferred is fed to a heat fixing device 5 as a fixing means by a feeding belt 42, and is heated and pressed, so that the toner images are fixed on the surface thereof. The recording material S on which the toner images are thus fixed thereafter passes through a sheet discharging feeding path 82 and is sent to a sheet discharge tray 65.

The toner remaining on the photosensitive drum 11 after the primary transfer (primary transfer residual toner) is removed from the photosensitive drum 11 by the cleaning device 15 and is collected. Further, the toner remaining on the intermediary transfer belt 31 after the secondary transfer (secondary transfer residual toner) is removed from the intermediary transfer belt 31 by the belt cleaning device 36 and is removed.

2. Charger

Next, the charger 12 in this embodiment will be described. In the following description, with respect to the image forming apparatus 100 or elements, such as the charger 12, of the image forming apparatus 100, a front side of the drawing sheet is a "front" side, and a rear side of the drawing sheet is a "rear" side. A depth direction connecting the front side and the rear side is substantially parallel to a longitudinal direction (rotational axis direction) of the photosensitive drum 11.

Figure 2:
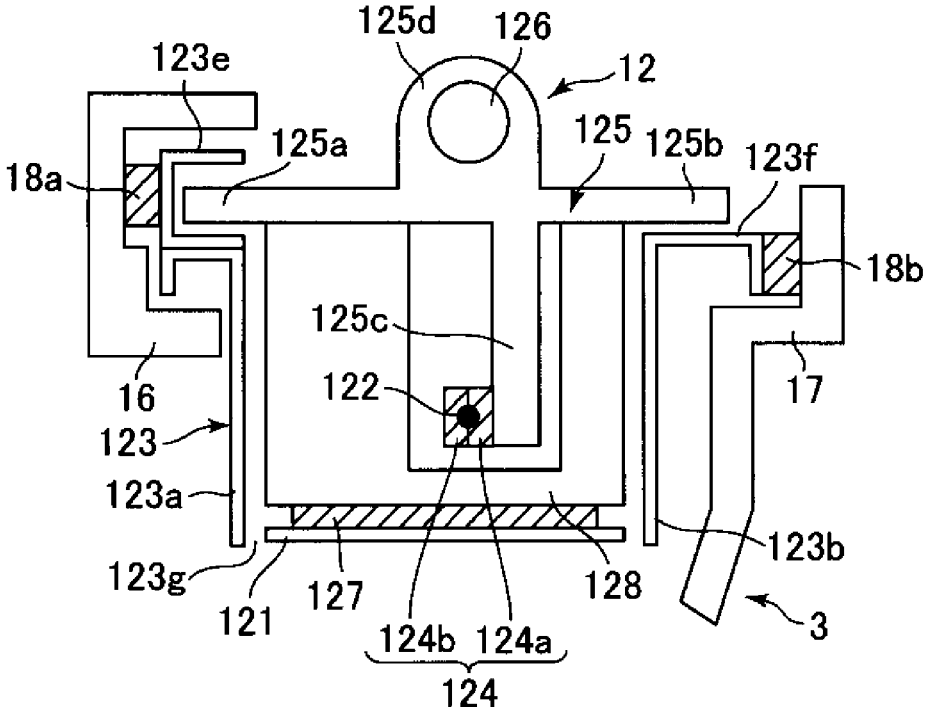
FIG. 2 is a schematic sectional view of a charger and a mounting portion therefor.
Figure 3:
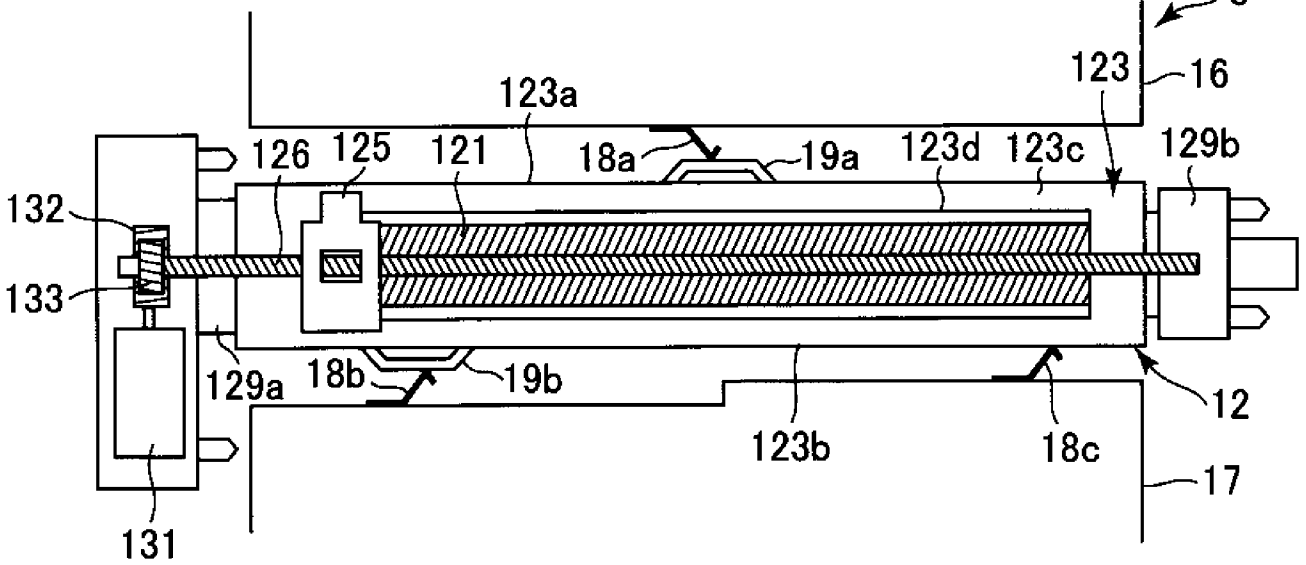
FIG. 3 is a top plan view of the charger and the mounting portion therefor.

FIG. 2 is a sectional view of the charger 12 as seen from the front side, and FIG. 3 is a top plan view of the charger 12 in which the front side is a left side of the drawing sheet. In FIGS. 2 and 3, a mounting portion 3, which will be described specifically later, for the charger 12 in an apparatus main assembly 2 of the image forming apparatus 100 is also shown.

In this embodiment, the charger 12 for charging the surface (surface-to-be-charged) of the photosensitive drum (member-to-be-charged) 11 is constituted by a corona charger (corona discharge generating device), particularly by scorotron. The charger 12 is provided with supporting blocks 129*a*, 129*b* at respective end portions of a shield case 123 as a shield constituting a supporting casing which is open at one surface thereof, and between these supporting blocks 129*a*, 129*b*, a discharge wire 122 as a discharge electrode is extended and stretched. Further, at an open surface 123*g* as an opening of the shield case 123, a grid 121 is provided between the discharge wire 122 and the photosensitive drum 11. This charger 12 is opposed to the surface of the photosensitive drum 11 in a close state on the open surface 123*g* side of the shield case 123, i.e., a side where the grid 121 is provided.

Further, the discharge wire 122 is disposed along (in this embodiment, in substantially parallel with) the longitudinal direction (axial direction) of the charger 12 disposed in substantially parallel with the photosensitive drum 11. The discharge wire 122 is connected with a high-voltage source (not shown). The discharge wire 122 generates corona discharge by applying a discharging bias thereto from the high-voltage source. As the discharge wire 122, it is possible to suitably use a wire material formed of metal, such as stainless steel, nickel, molybdenum or tungsten. In this embodiment, as the discharge wire 122, the wire material of tungsten having high stability among metals is used. Further, the diameter of the discharge wire 122 may preferably be 40 μm-100 μm. This is because when the diameter is excessively small, the discharge wire 122 is liable to break by ion collision due to electric discharge and when the diameter is excessively large, a large applied voltage is needed for obtaining stable corona discharge. In this embodiment, the diameter of the discharge wire is 50 μm.

The shield case 123 includes side-portion shield plates 123*a*, 123*b* each provided at an opposing position via the discharge wire 122 along the longitudinal direction of the charger 12. The shield case 123 further includes a top shield plate 123*c* provided at an opposing position to the photosensitive drum 11 (grid 121) via the discharge wire 122 along the longitudinal direction of the charger 12. A surface opposing the top shield plate 123*c* of the shield case 123 is the open surface 123*g*. Of the side-portion shield plates 123*a*, 123*b*, the shield plate disposed on a left side as seen from the front side is a left-side shield plate 123*a*, and the shield plate disposed on a right side is a right-side shield plate 123*b*. In this embodiment, the side-portion shield plates 123*a*, 123*b* and the top shield plate 123*c* are integrally constituted. The top shield 123*c* is provided with a through hole 123*d* so as to enable movement of a holding member for a cleaning member described later. Thus, the shield case 123 is disposed so as to surround the discharge wire 122 at surfaces except for one surface on the photosensitive drum 11 side. The shield case 123 is constituted by metal and is electrically grounded.

The grid 121 is a metal-made plate member and is disposed at the open surface (opening) 123g on the photosensitive drum 11 side of the shield case 123. The grid 121 has a porous shape (mesh shape, slit shape) in which a plurality of through holes penetrate through a side facing the photosensitive drum 11 and a side facing the discharge wire 122. The grid 121 is connected with a constant-voltage source (not shown). A grid bias applied from the constant-voltage source to the grid 121 is controlled, so that electric charge generated by the discharge wire 122 is rectified and thus an amount of the electric charges imparted to the photosensitive drum 11 is adjusted.

In this embodiment, the charger 12 includes a cleaning pad 124 which is a cleaning member for cleaning the discharge wire 122 and a cleaning brush 127 (cleaning member) which is a cleaning member for cleaning the grid 121. The cleaning pad 124 is held by a cleaning pad holding member 125, and the cleaning brush 127 is held by a cleaning brush holding member 128 as a movable member. The cleaning pad 124 includes two portions consisting of a first portion 124*a* and a second portion 124*b* each constituted by a sponge to which surface a nonwoven cloth is bonded. The cleaning pad 124 contacts the discharge wire 122 so as to sandwich the discharge wire 122 by these (two) portions 124*a*, 124*b*. The cleaning brush 127 is constituted by weaving an acrylic brush on a base material and contacts the grid 121 having open holes so as to enter the open holes.

Figure 4:
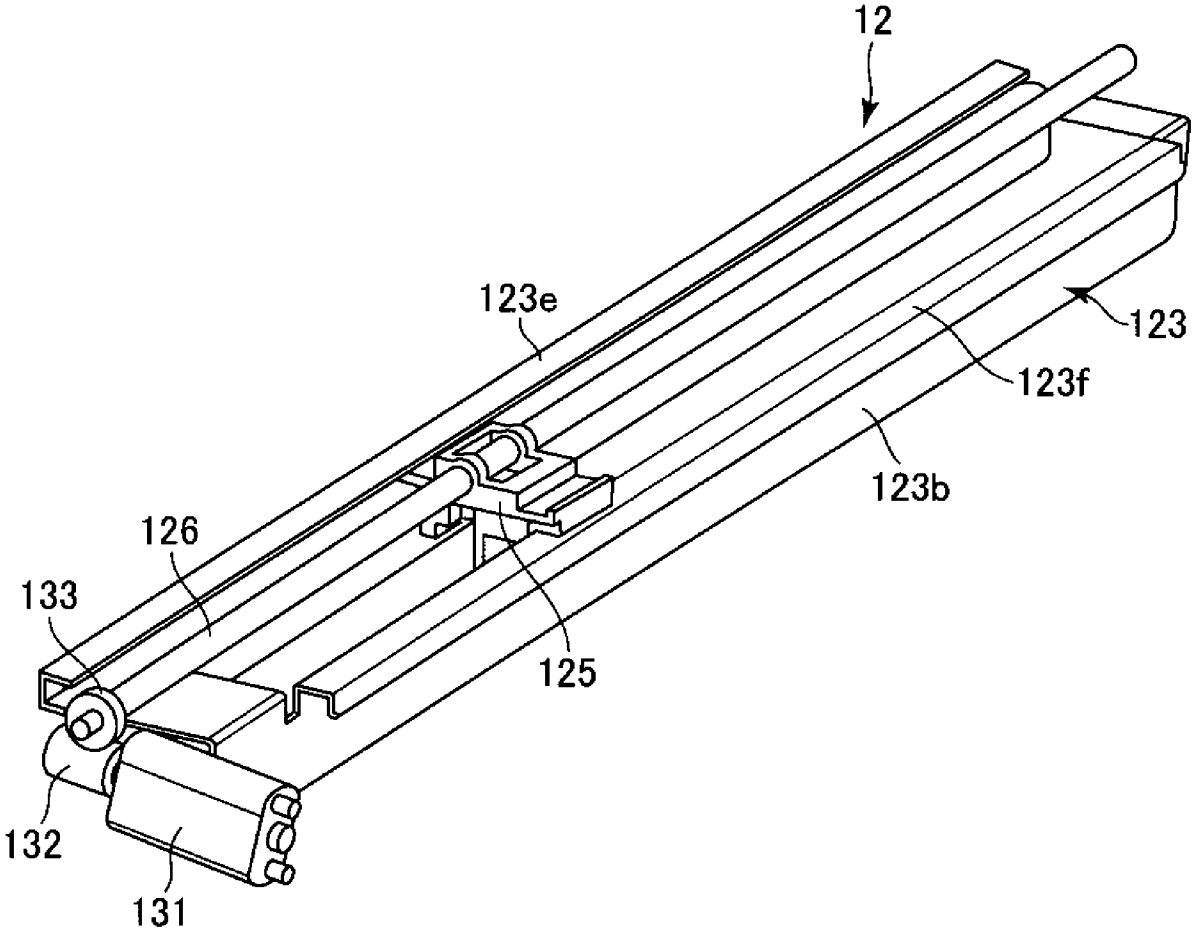
FIG. 4 is a perspective view of a driving constitution of a cleaning member in the charger.

FIG. 4 is a perspective view, of the charger 12, showing a drive constitution of the cleaning member in this embodiment. The cleaning pad holding member 125 as the movable member is held movably in the longitudinal direction of the charger 12 with the shield case 123 as a rail. Specifically, in this embodiment, on an opposite side of the left-side shield plate 123*a* to the photosensitive drum 11, an engaging groove 123*e* is formed. The engaging groove 123*e* may be formed integrally with the left-side shield plate 123*a* or may also be connected with a separate member from the left-side shield plate 123*a*. The right-side shield plate 123*b* is bent on an opposite side to the photosensitive drum 11, and on an upper surface thereof, a rail surface 123*f* is formed. Of the cleaning pad holding member 125, a support receiving portion 125*a* formed at one end portion with respect to a direction crossing (in this embodiment, substantially perpendicular to) a movement direction thereof is disposed in the engaging groove 123*e*, and a support receiving portion 125*b* formed at the other end portion with respect to the same direction is disposed on the rail surface 123*f*. Then, between the support receiving portions 125*a*, 125*b*, not only the cleaning pad 124 is held by a pad holding portion 125*c* provided on the discharge wire 122 side, but also a drive receiving portion 125*d* provided on an opposite side to the discharge wire 122 is engaged with a screw 126.

The screw 126 is disposed so that a longitudinal direction (rotational axis direction) thereof is substantially parallel to the longitudinal direction of the charger 12, and to one end portion (front side) thereof with respect to the longitudinal direction, a screw gear 133 is fixed. Further, with this screw gear 133, a motor gear 132 fixed to a driving shaft (output shaft) of a driving motor 131 as a driving source is engaged. By this, the driving motor 131 is rotated, so that the screw 126 is rotated via the motor gear 132 and the screw gear 133 and thus the cleaning pad holding member 125 can be moved along the longitudinal direction of the charger 12. The cleaning brush holding member 128 as the movable member is connected with the cleaning pad holding member 125 as the movable member, and therefore by moving the cleaning pad holding member 125, it is also possible to move the cleaning brush holding member 128 simultaneously. Incidentally, by switching between normal rotation and reverse rotation of the driving motor 131, the movement direction of the cleaning pad holding member 125 and the cleaning brush holding member 128 can be switched between a forward direction and a backward direction. Thus, the cleaning pad 124 and the cleaning brush 127 which are movable members can be reciprocated in the longitudinal direction of the charger 12 along the shield plates 123*a*, 123*b*.

3. Vibration Isolation (Preventing) Constitution

Next, a vibration isolation (preventing) constitution for the charger 12 in this embodiment will be described.

The charger 12 is mounted in a mounting portion 3 provided in the apparatus main assembly 2 of the image forming apparatus 100. The mounting portion 3 includes a left rail 16 as a first supporting member provided on a left side of the charger 12 as seen from the front side and a right rail 17 as a second supporting member provided on a right side. The charger 12 is disposed between the left rail 16 and the right rail 17.

In this embodiment, the left rail 16 is provided with a first urging member 18*a* as a first urging portion between itself and the left-side shield plate 123*a*. The right rail 17 is provided with second and third urging members 18*b*, 18*c* as second and third urging portions between itself and the right-side shield plate 123*b*. By this, the charger 12 is sandwiched between the left rail 16 and the right rail 17 via the first, second and third urging members 18*a*, 18*b*, 18*c*.

The first, second and third urging members 18*a*, 18*b*, 18*c* urge the shield case 123 of the charger 12 in a direction crossing the longitudinal direction of the charger 12 at the respective mounting portions 3. Here, the first urging member 18*a* and the second and third urging members 18*b*, 18*c* urge the shield case 123 of the charger 12 from their opposing sides. Further, the second and third urging members 18*b*, 18*c* urge the shield case 123 of the charger 12 on one end portion side and on the other portion side relative to the first urging member 18*a* with respect to the longitudinal direction of the charger 12. Particularly, in this embodiment, the first urging member 18*a* urges the shield case 123 of the charger 12 substantially at a central portion with respect to the longitudinal direction of the charger 12. Further, in this embodiment, each of the second and third urging members 18*b*, 18*c* urges the shield case 123 of the charger 12 at a position spaced from the first urging member 18*a* by the same distance with respect to the longitudinal direction of the charger 12. Here, places (portions) of the shield urged by the first, second and third urging portions are referred to as first, second and third portions-to-be-urged.

Thus, on the left rail 16 at a position corresponding to the central portion of the charger 12 with respect to the longitudinal direction, the first urging member 18*a* is provided. Further, on the right rail 17 at positions corresponding to respective end portions of the charger 12 with respect to the longitudinal direction, the second and third urging members 18*b*, 18*c* are provided. Further, by the first urging member 18*a* and the second and third urging members 18*b*, 18*c*, the left-side shield plate 123*a* and the right-side shield plate 123*b* of the charger 12 are urged, respectively. By this, the charger 12 is vibration-isolated (prevented) and fixed.

In this embodiment, as the urging members 18 (18*a*, 18*b*, 18*c*), a metal-made leaf spring is used. However, the urging member is not limited thereto, but an elastic member such as sponge may also be used.

Further, as a vibration isolation constitution for the charger 12, it is desirable that the charger 12 is sandwiched by the urging members 18 from left and right sides. At this time, from a property of the shield case 123 which is the supporting casing open at one surface thereof as in this embodiment, particularly when the shield case 123 is urged at the central portion with respect to the longitudinal direction, a vibration-isolating (preventing) effect can be easily obtained. However, in the case where the two urging members 18 for urging the charger 12 from the left and right sides are disposed at the central portion with respect to the longitudinal direction, the rail portions (engaging groove 123*e*, rail surface 123*f*) of the shield plates 123*a*, 123*b* for supporting the cleaning pad holding member 125 deform in some cases. Further, for example, a rail-rail distance becomes small at the central portion with respect to the longitudinal direction, so that drive of the cleaning pad holding member 125 as the movable member is impaired in some cases.

Therefore, in this embodiment, of the left and right sides of the charger 12, one urging member is provided on one side at the central portion with respect to the longitudinal direction of the charger 12 and two urging members are provided on the other side at the respective end portions with respect to the longitudinal direction of the charger 12, so that the charger 12 is held by the three urging members 18 (18*a*, 18*b*, 18*c*) in total. By this, it becomes possible to effect vibration isolation of the charger 12 while suppressing the deformation as described above.

Here, as a balance of urging forces of the three urging members 18 (18*a*, 18*b*, 18*c*), from a relationship of a balance between force and moment, it is desirable that first urging member 18*a*:second urging member 18*b*:third urging member 18*c*=2:1:1. In the case of being remarkably out of this relationship, for example, in the case where a positioning shaft or the like for supporting the charger 12 is provided in addition to the urging members 18 (18*a*, 18*b*, 18*c*), an unnecessary load is exerted on a supporting portion of the positioning shaft and causes the deformation or the like. In this embodiment, the urging force of the first urging member 18*a* is 15 N, and the urging force of each of the second and third urging members 18*b*, 18*c* is 7.5 N.

Incidentally, in this embodiment, in order to improve operativity of a mounting and demounting operation (inserting and pulling operation) of the charger 12 as described specifically later, contact positions (first, second and third portions-to-be-urged) of the charger 12 with the first, second and third urging members 18*a*, 18*b*, 18*c* are set as follows.

First, the left-side shield plate 123*a* is provided with a first projected portion 19*a*, and the first urging member 18*a* contacts the first projected portion 19*a* to urge the charger 12. The first projected portion 19*a* projects in a side opposite to an urging direction of the charger 12 by the first urging member 18*a* with respect to an outer configuration of the charger 12 formed by the left-side shield plate 123*a*. Further, the right-side shield plate 123*b* is provided with a second projected portion 19*b*, and the second urging member 18*b* contacts the second projected portion 19*b* to urge the charger 12. The second projected portion 19*b* projects in a side opposite to an urging direction of the charger 12 by the second urging member 18*b* with respect to an outer configuration of the charger 12 formed by the right-side shield plate 123*b*. That is, the contact positions of the charger 12 with the first and second urging members 18*a*, 18*b* project in opposite sides to the urging directions of the charger 12 by the first and second urging members 18*a*, 18*b* with respect to associated outer configurations of the shield case 123 of the charger 12. In other words, the contact positions of the charger 12 with the first and second urging members 18*a*, 18*b* are recessed toward the left rail 16 and the right rail 17 with respect to associated outer configurations of the shield case 123 of the charger 12.

Of the two urging members 18*b*, 18*c* provided on the right rail 17, the third urging member 18*c* positioned on the rear side of the apparatus main assembly 2 is disposed at a position closer to the charger 12 than the second urging member 18*b* positioned on the front side is. The contact position of the charger 12 with the second urging member 18*b* projects in the opposite side to the urging direction of the charger 12 by the second and third urging members 18*b*, 18*c*. In this embodiment, the rear side of the apparatus main assembly 2 corresponds to a leading side of an inserting direction of the charger 12 into the mounting portion 3 as described later.

Thus, in this embodiment, the first urging member 18*a* urges the left-side shield plate 123*a* via the first projected portion 19*a*. The second urging member 18*b* urges the right-side shield plate 123*b* via the second projected portion 19*b*. The third urging member 18*c* directly urges the right-side shield plate 123*b* of the charger 12.

4. Mounting and Demounting Operation

Figure 5:
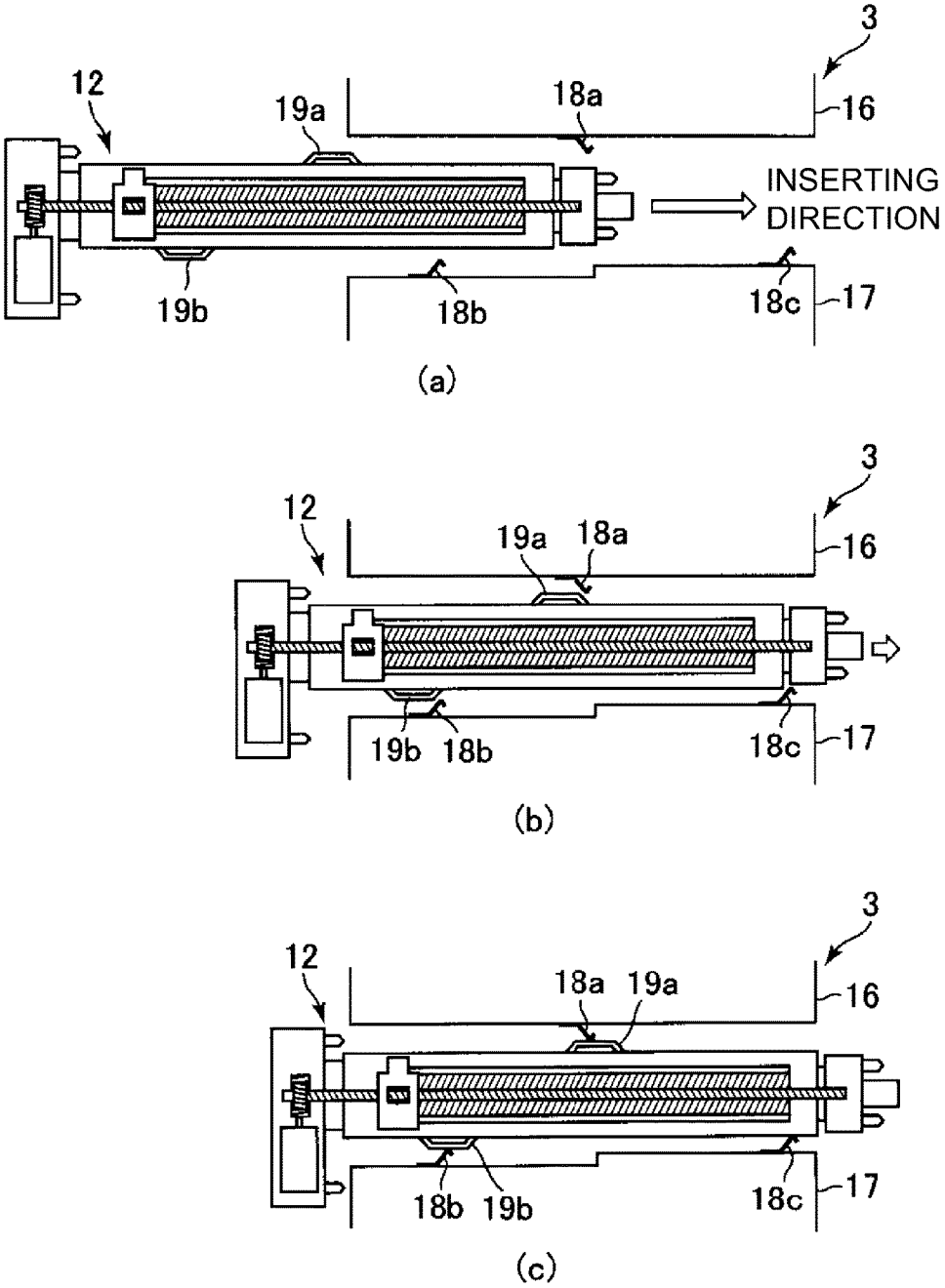
FIG. 5 includes illustrations of an operation when the charger is inserted into the mounting portion of an apparatus main assembly.

Next, a mounting and demounting operation (inserting and pulling operation) of the charger 12 in this embodiment will be described. FIG. 5 includes top plan views of the charger 12 and the mounting portion 3 for illustrating an operation when the charger 12 is inserted into the mounting portion 3 of the apparatus main assembly 2.

As shown in (a) of FIG. 5, when the charger 12 in inserted into the mounting portion 3 of the apparatus main assembly 2, the charger 12 can be smoothly inserted with no contact of the first and second urging members 18*a*, 18*b* with the left-side and right-side shield plates 123*a*, 123*b*. This is because the first and second urging members 18*a*, 18*b* through which the leading side of the charger 12 passes when the charger 12 is inserted into the mounting portion 3 of the apparatus main assembly 2 are recessed toward the left and right rails 16, 17 with respect to the outer configuration of the charger 12 formed by the left-side and right-side shield plates 123*a*, 123*b*.

Then, as shown in (b) of FIG. 5, immediately before the charger 12 reaches a predetermined fixing position of the mounting portion 3, the first and second urging members 18*a*, 18*b* start contact with the first and second projected portions 19*a*, 19*b*, respectively. Substantially simultaneous with this, the third urging member 18*c* disposed on the rear side (leading end side of the inserting direction) of the apparatus main assembly 2 starts contact with the outer configuration of the charger 12 formed by the right-side shield plate 123*b*.

Finally, as shown in (c) of FIG. 5, when the charger 12 reaches the predetermined fixing position of the mounting portion 3, all of the urging members 18*a*, 18*b*, 18*c* urge and fix the charger 12.

Thus, in this embodiment, the charger 12 can be inserted into and pulled out from the mounting portion 3 along the longitudinal direction of the charger 12. Further, in this embodiment, the first, second and third urging members 18*a*, 18*b*, 18*c* are provided at the mounting portion 3 and are elastically deformed by inserting the charger 12 into the mounting portion 3, and urge the shield case 123 of the charger 12 by an elastic restoring force. Further, the third urging member 18*c* is disposed on the leading end side of the inserting direction of the charger 12 more than the second urging member 18*b*. Then, when the charger 12 is inserted into the mounting portion 3, substantially simultaneously with start of the urging of the shield case 123 of the charger 12 by the first and second urging members 18*a*, 18*b*, the third urging member 18*c* starts the urging of the shield case 123 of the charger 12.

By such a constitution, an operator such as a user or a service person can feel the urging force accurately immediately before the charger 12 reaches the predetermined fixing position when the charger 12 is inserted into the mounting portion, and therefore it is possible to prevent an erroneous operation.

5. Effect

As described above, according to this embodiment, it is possible to stably urge and support the charger 12 without impairing motion of the cleaning members 124, 127 moving in the charger 12, and it is possible to suppress the vibration of the charger 12 causing an image defect. Further, when the charger 12 is inserted, an urging feeling can be obtained immediately before the charger 12 reaches the predetermined fixing position, and therefore the operator can easily recognize mounting of the charger 12 to the predetermined fixing position, so that operativity can be improved. Accordingly, according to this embodiment, it becomes possible to stably support the charger 12 while suppressing undesirable deformation.

Others

As described above, the present invention was described in accordance with specific embodiment, but the present invention is not limited to the above-described embodiment.

In the above-described embodiment, the case where the corona charger (corona discharge generating device) is the charger for electrically charging the photosensitive member was described, but the corona charger is not limited thereto. For example, the corona charger is also used as a toner charging means for charging the toner image on the image bearing member before the transfer and a transfer residual toner charging means for charging the transfer residual toner remaining on the image bearing member after the transfer. Further, the corona charger is also used as a discharging means for discharging the surface of the image bearing member, a transfer means for transferring the toner image from the image bearing member onto a transfer receiving member, and the like means. In these cases, the image bearing member is not limited to the photosensitive member but may also be an intermediary transfer member. Even in the case where the corona charger is used for either of these purposes, a similar effect can be obtained by similarly applying the present invention thereto.

Further, in the above embodiment, the corona charger is detachably mountable to the mounting portion provided in the apparatus main assembly, but is not limited thereto. For example, the photosensitive member and process means, actable on the photosensitive member, selected from the group consisting of the charging means, the developing means, and the cleaning means are integrally assembled into a cartridge to constitute a process cartridge detachably mountable to the apparatus main assembly of the image forming apparatus. Such a cartridge detachably mountable to the apparatus main assembly of the image forming apparatus may include a mounting portion for the corona charger according to the present invention, and the corona charger according to the present invention may also be detachably mountable to the mounting portion. Further, the corona charger is not limited to a constitution which is detachably mountable relatively easily as an exchangeable unit by the operator such as the user or the service person. The corona charger may also be substantially a corona charger which is not mounted and demounted usually except for the case of repair or the like after being mounted in the mounting portion during manufacturing of the image forming apparatus or the like.

INDUSTRIAL APPLICABILITY

According to the present invention, in a constitution in which the corona charger is supported by the supporting members adjacent to the respective sides of the corona charger with respect to the circumferential direction of the photosensitive member, it is possible to provide the image forming apparatus capable of suppressing the charging non-uniformity due to the vibration of the corona charger without impairing the motion of the grid cleaning member.

EXPLANATION OF SYMBOLS

3 mounting portion
11 photosensitive drum
12 charger
16 left rail
17 right rail
18 urging member
100 image forming apparatus
121 grid
122 discharge wire
123 shield plate
124 cleaning pad
125 cleaning pad holding member
127 cleaning brush
128 cleaning brush holding member

The invention claimed is:

1. An image forming apparatus comprising:

a rotatable photosensitive member;

a corona charger detachably mountable to an image forming apparatus main assembly, configured to electrically charge said photosensitive member, and including a discharging electrode, a first shield portion, a second shield portion, a cleaning member, and a movable member; and a first urging member and a second urging member, provided in said image forming apparatus main assembly and having elasticity, configured to urge said corona charger in directions crossing a longitudinal direction of said corona charger when said corona charger is mounted in said image forming apparatus main assembly, said discharging electrode effecting electric discharge under application of a voltage and being provided along the longitudinal direction, said first shield portion and said second shield portion, having a plate shape, being provided along the longitudinal direction at opposing positions with respect to said discharging electrode, said cleaning member cleaning a portion-to-be-cleaned in said corona charger and being moved while contacting the portion-to-be-cleaned, said movable member, holding said cleaning member, being moved in the longitudinal direction while being guided by said first shield portion and said second shield portion, said first urging member urging said first shield portion toward said second shield portion, said second urging member urging said second shield portion toward said first shield portion, and said first urging member and said second urging member being provided so that a first portion-to-be-urged of said first shield portion urged by said first urging member and a second portion-to-be-urged of said second shield portion urged by said second urging member are in non-opposing positions relative to each other with respect to the longitudinal direction when said corona charger is mounted in said image forming apparatus main assembly.

2. An image forming apparatus according to claim 1, wherein said first portion-to-be-urged and said second portion-to-be-urged are positioned at locations spaced from each other, with respect to the longitudinal direction, at a distance longer than a width of said movable member with respect to the longitudinal direction of said corona charger.

3. An image forming apparatus according to claim 1, further comprising a third urging member in said image forming apparatus main assembly, said third urging member having elasticity and configured to urge said corona charger in a direction crossing the longitudinal direction when said corona charger is mounted in said image forming apparatus main assembly, said third urging member urging said second shield portion toward said first shield portion, and said third urging member is provided so that a third portion-to-be-urged of said second shield portion urged by said third urging member is in a non-opposing position to said first portion-to-be-urged with respect to the longitudinal direction when said corona charger is mounted in said image forming apparatus main assembly.

4. An image forming apparatus according to claim 3, wherein with respect to the longitudinal direction, said first urging member, said second urging member, and said third urging member are provided so that said first portion-to-be-urged is positioned between said second portion-to-be-urged and said third portion-to-be-urged when said corona charger is mounted in said image forming apparatus main assembly.

5. An image forming apparatus comprising:

a rotatable photosensitive member;

a corona charger detachably mountable to an image forming apparatus main assembly, configured to electrically charge said photosensitive member, and including a discharging electrode, a first shield portion, a second shield portion, a cleaning member, and a movable member; and a first urging member and a second urging member, provided in said image forming apparatus main assembly and having elasticity, configured to urge said corona charger in directions crossing a longitudinal direction of said corona charger when said corona charger is mounted in said image forming apparatus main assembly, wherein said discharging electrode effects electric discharge under application of a voltage and is provided along the longitudinal direction, and said first shield portion and said second shield portion have a plate shape and are provided along the longitudinal direction at opposing positions with respect to said discharging electrode, wherein said cleaning member cleans a portion-to-be-cleaned in said corona charger and is moved while contacting the portion-to-be-cleaned, wherein said movable member holds said cleaning member and is moved in the longitudinal direction while being guided by said first shield portion and said second shield portion, wherein said first urging member urges said first shield portion toward said second shield portion, wherein said second urging member urges said second shield portion toward said first shield portion, and wherein said first urging member and said second urging member are provided so that a first portion-to-be-urged of said first shield portion urged by said first urging member and a second portion-to-be-urged of said second shield portion urged by said second urging member are not in opposing positions relative to each other with respect to the longitudinal direction when said corona charger is mounted in said image forming apparatus main assembly.

6. An image forming apparatus according to claim 5, wherein said first portion-to-be-urged and said second portion-to-be-urged are positioned at locations spaced from each other, with respect to the longitudinal direction, at a distance longer than a width of said movable member with respect to the longitudinal direction of said corona charger.

7. An image forming apparatus according to claim 5, further comprising a third urging member in said image forming apparatus main assembly, said third urging member having elasticity and configured to urge said corona charger in a direction crossing the longitudinal direction when said corona charger is mounted in said image forming apparatus main assembly, said third urging member urging said second shield portion toward said first shield portion, and said third urging member being provided so that a third portion-to-be-urged of said second shield portion urged by said third urging member is not in an opposing position relative to said first portion-to-be-urged with respect to the longitudinal direction when said corona charger is mounted in said image forming apparatus main assembly.

8. An image forming apparatus according to claim 7, wherein with respect to the longitudinal direction, said first urging member, said second urging member, and said third urging member are provided so that said first portion-to-be-urged is positioned between said second portion-to-be-urged and said third portion-to-be-urged when said corona charger is mounted in said image forming apparatus main assembly.

9. An image forming apparatus according to claim 5, wherein said first urging member is disposed so that said first portion-to-be-urged is positioned at a central portion of said corona charger with respect to the longitudinal direction.

10. An image forming apparatus according to claim 5, wherein said corona charger is mountable in the image forming apparatus main assembly by being moved in the longitudinal direction.

11. An image forming apparatus according to claim 5, wherein each of said first shield portion and said second shield portion is provided with a guiding portion configured to guide said movable member in the longitudinal direction when said movable member is moved.

12. An image forming apparatus according to claim 5, wherein said image forming apparatus main assembly is provided with a first guide member and a second guide member which are configured to guide said corona charger when said corona charger is mounted in said image forming apparatus main assembly, wherein said first guide member includes said first urging member, and wherein said second guide member includes said second urging member.

13. An image forming apparatus according to claim 5, wherein said corona charger comprises a grid provided at an opening on said photosensitive member side of said first shield portion and said second shield portion, and wherein when said corona charger is mounted in said image forming apparatus main assembly, the portion-to-be-cleaned includes said grid.

14. An image forming apparatus according to claim 13, wherein said grid comprises a mesh-shaped metal plate member provided with a plurality of openings.

15. An image forming apparatus according to claim 13, wherein said cleaning member includes a brush.

16. An image forming apparatus according to claim 5, wherein said first urging member and said second urging member include metal leaf springs.

* * * * *